US009077121B2

(12) United States Patent
Funamura et al.

(10) Patent No.: US 9,077,121 B2
(45) Date of Patent: Jul. 7, 2015

(54) PINS FOR CONNECTOR ALIGNMENT

(71) Applicant: Apple Inc., Cupertino, CA (US)

(72) Inventors: Joshua Funamura, San Jose, CA (US); Zheng Gao, San Jose, CA (US); Laura DeForest, San Mateo, CA (US); Stephen Jayanathan, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 147 days.

(21) Appl. No.: 13/657,636

(22) Filed: Oct. 22, 2012

(65) Prior Publication Data

US 2014/0113482 A1 Apr. 24, 2014

(51) Int. Cl.

| | |
|---|---|
| ***H01R 13/64*** | (2006.01) |
| ***H01R 12/70*** | (2011.01) |
| ***H01R 13/74*** | (2006.01) |

(52) U.S. Cl.

CPC ..... *H01R 12/7052* (2013.01); *H01R 13/74* (2013.01)

(58) Field of Classification Search

USPC ..... 439/378, 465, 731, 752, 941, 83, 676, 439/636, 680

See application file for complete search history.

(56) References Cited

U.S. PATENT DOCUMENTS

| | | | | |
|---|---|---|---|---|
| 5,466,171 | A * | 11/1995 | Bixler et al. | 439/378 |
| 6,203,341 | B1 * | 3/2001 | Chen | 439/186 |
| 6,644,980 | B2 * | 11/2003 | Kameda | 439/65 |
| 6,726,503 | B2 * | 4/2004 | Waddell et al. | 439/465 |
| 6,866,533 | B2 * | 3/2005 | Wu | 439/352 |
| D540,259 | S * | 4/2007 | Huang et al. | D13/133 |
| 8,152,557 | B2 * | 4/2012 | Blanton et al. | 439/362 |
| 8,764,475 | B2 * | 7/2014 | Maher et al. | 439/391 |
| 2005/0032410 | A1 * | 2/2005 | Huang | 439/362 |

* cited by examiner

*Primary Examiner* — Jean F Duverne

(74) *Attorney, Agent, or Firm* — Kilpatrick Townsend & Stockton LLP

(57) ABSTRACT

Connector receptacles that may help maintain registration or alignment between a printed circuit board, a connector receptacle, and an opening in a device enclosure. One example may provide a connector receptacle having a housing including a passage. A pin may be placed in the passage such that a first portion extends away from a front of the housing and a rear portion extends away from a rear of the housing. The front portion may be arranged to fit in a cavity or opening in an inside surface of a device enclosure, while the rear portion may be arranged to fit in a cavity or opening in a top surface of a printed circuit board.

22 Claims, 5 Drawing Sheets

PINS FOR CONNECTOR ALIGNMENT

BACKGROUND

The numbers and types of electronic devices available to consumers have increased tremendously the past few years, and this increase shows no signs of abating. Devices such as portable computing devices, tablets, desktop computers, laptops, all-in-one computers, cell phones, smart phones, media phones, storage devices, portable media players, navigation systems, monitors and other devices have become ubiquitous.

These devices often receive power and share data using various cables. These cables may have connector inserts, or plugs, on each end. The connector inserts may plug into connector receptacles on electronic devices, thereby forming one or more conductive paths for signals and power.

Devices typically have openings that allow access to connector receptacles. These openings may provide access to one or more contacts in the receptacles, which may mate with corresponding contacts in connector inserts or electronic devices, such as memory cards. The connector receptacles are often located on a printed circuit board, such as a main or mother board. The one or more contacts in the connector receptacle may connect to corresponding traces on the printed circuit board.

Accordingly, in these devices, a connector receptacle resides on a printed circuit board and has an opening aligned (or what may be referred to as "registered") to an opening in an enclosure in the electronic device.

Unfortunately, during shipment and usage, the printed circuit board may shift relative to the device enclosure. This shift, may, in turn, change the position of the opening of the connector receptacle relative to the opening in the device enclosure. A small shift may mar the appearance of the electronic device. A large shift may interfere with the operation of the electronic device.

Thus, what is needed are connector receptacles that may aid in maintaining registration or alignment of the connector receptacle to an opening in a device enclosure.

SUMMARY

Accordingly, embodiments of the present invention may provide connector receptacles that may aid in maintaining registration or alignment of the connector receptacle to an opening in a device enclosure. In various embodiments of the present invention, connector receptacles may help maintain registration or alignment between a printed circuit board, such a main logic board, and an opening in a device enclosure. In various embodiments of the present invention, connector receptacles may help maintain registration or alignment between a printed circuit board the connector receptacle, and an opening in a device enclosure.

An illustrative embodiment of the present invention may provide a connector receptacle having a housing. The housing may include a passage. A pin may be placed in the passage such that a first portion extends away from a front of the housing and a rear portion extends away from a rear of the housing. The front portion may be arranged to fit in a cavity or opening in an inside surface of a device enclosure, where the device enclosure encloses the electronic device that includes the connector receptacle. The rear portion may be arranged to fit in a cavity or opening in a top surface of a printed circuit board.

By securing a device enclosure and printed circuit board together in this way, the printed circuit board is less likely to move relative to the device enclosure. This may help an opening in the connector to remain aligned to an opening in the device enclosure, thereby maintaining an attractive appearance of the electronic device. This may be particularly helpful when the printed circuit board is positioned vertically during use, since such a position may cause the printed circuit board to sag relative to the device enclosure.

In various embodiments of the present invention, the printed circuit board and device enclosure may be oblique, that is, they may not be parallel or at a right angle. In such a situation, pins according to embodiments of the present invention may have one or more portions angled relative to each other. For example, a rear portion of a pin may be angled relative to a front portion of the pin.

In various embodiments of the present invention, the connector receptacle may include a cavity to support a number of contacts, each contact having a contacting portion to mate with a corresponding contact on a connector insert or electronic component, such as a memory card. Each contact may further a tail portion extending away from a rear of the housing. These tail portions may form through-hole contacts or surface-mount contacts. An opening of the connector receptacle may align to an opening in the device enclosure.

In various embodiments of the present invention, instead of a pin, protrusions may be formed on a device housing. These protrusions may be formed together or separately from the housing. These protrusions may include a first protrusion extending away from a front of the housing and a rear protrusion extending away from a rear of the housing. The front protrusion may be arranged to fit in a cavity or opening in an inside surface of a device enclosure, where the device enclosure encloses the electronic device that includes the connector receptacle. The rear protrusion may be arranged to fit in a cavity or opening in a top surface of a printed circuit board. These protrusions may be formed of plastic, metal, or other material.

An illustrative embodiment of the present invention may provide a connector receptacle including a housing having a cavity and a passage, a plurality of contacts located in the cavity of the housing, and a pin. The pin may include a front portion extending away from a front of the housing, a middle portion located in the passage of the housing, and a rear portion extending away from a rear of the housing.

An illustrative embodiment of the present invention may provide an electronic device. The electronic device may include a device enclosure having a first opening and a first cavity, a printed circuit board having a first cavity, and a connector receptacle. The connector receptacle may include a housing having a cavity and a passage, a plurality of contacts located in the cavity of the housing, and a pin. The pin may include a front portion extending away from a front of the housing into the cavity in the device enclosure, a middle portion located in the passage of the housing, and a rear portion extending away from a rear of the housing into the cavity in the printed circuit board. The cavity of the housing may be aligned with the opening in the device enclosure.

An illustrative embodiment of the present invention may provide a method of assembling an electronic device. This method may include inserting a pin into a passage of a housing of a connector receptacle such that the pin includes a front portion extending away from a front of the housing, a middle portion located in the passage of the housing, and a rear portion extending away from a rear of the housing, inserting the front portion of the pin into an opening in a device enclosure, and inserting the rear portion of the pin into a printed circuit board.

Again, in some embodiments of the present invention, instead of a pin, protrusions extending from the housing may be used. These protrusions may be formed with the housing, or they may be formed separately. They may be plastic, metallic, or made from another material. Accordingly an illustrative embodiment of the present invention may provide a connector receptacle. The connector receptacle may include a housing having a cavity, a front protrusion, and a rear protrusion, and a plurality of contacts located in the cavity of the housing. The front protrusion may be arranged to fit in an opening in a device enclosure and the rear protrusion may be arranged to fit in an opening in a printed circuit board.

Embodiments of the present invention may provide connector receptacles for various types of devices, such as portable computing devices, tablets, desktop computers, laptops, all-in-one computers, cell phones, smart phones, media phones, storage devices, portable media players, navigation systems, monitors and other devices. These connector receptacles may provide pathways for signals and power compliant with various standards such as Universal Serial Bus (USB), a High-Definition Multimedia Interface (HDMI), Digital Visual Interface (DVI), power, Ethernet, DisplayPort, Thunderbolt, Lightning and other types of interfaces.

Various portions of connector receptacle 110 may be formed of various materials. For example, the housings and protrusions may be formed of silicon or silicone, rubber, hard rubber, plastic, nylon, liquid-crystal polymers (LCPs), or other nonconductive material or combination of materials. The contacts, pins, and protrusions may be formed of stainless steel, steel, copper, copper titanium, phosphor bronze, or other material or combination of materials. They may be plated or coated with nickel, gold, or other material.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
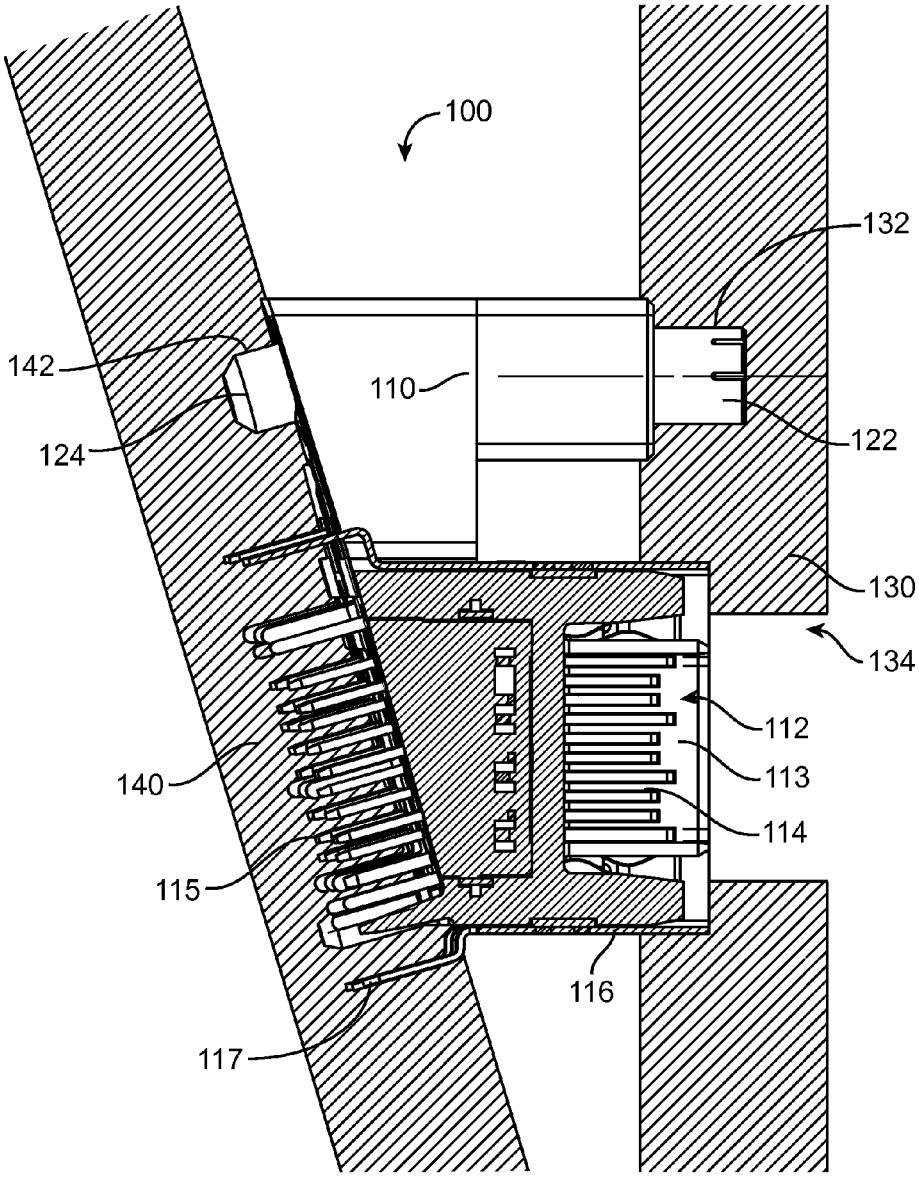
FIG. 1 illustrates a connector receptacle and portion of an electronic device according to an embodiment of the present invention.

FIG. 1 illustrates a connector receptacle and portion of an electronic device according to an embodiment of the present invention. This figure, as with the other included figures, is shown for illustrative purposes and does not limit either the possible embodiments of the present invention or the claims. Also, the description below may make reference to common reference numbers among different figures. To maintain readability, this is not redundantly pointed for each occurrence.

Connector receptacle 100 may be located in an electronic device having a device enclosure 130. Connector receptacle 100 may be attached to printed circuit board 140. Printed circuit board 140 may be a may be a main logic board or other appropriate substrate. While embodiments of the present invention are particularly well-suited to printed circuit boards, other types of boards, such as flexible circuit boards or other substrates may be included. Connector receptacle 100 may include housing 110 having cavity 113. Cavity 113 may have opening 112, which may be aligned or registered to opening 134 in device enclosure 130. Cavity 113 may include contacts having contacting portions 114. These contacts may further include tail portions 115 emerging from a rear of housing 110 that are inserted into openings in printed circuit board 140. Connector receptacle 100 may further include shielding 116, which may include tabs 117. Tabs 117 may be located or inserted in openings in printed circuit board 140.

Housing 110 may further include a passage (not shown) for a pin. This pin may include front portion 122 and rear portion 124. Front portion 122 may be located in a cavity, opening, or depression 132 in device enclosure 130. Rear portion 124 may be located in a cavity, opening, or depression 142 in printed circuit board 140.

By securing device enclosure 130 and printed circuit board 140 together in this way, printed circuit board is less likely to move relative to device enclosure 130. This may help opening 112 in connector 100 to remain aligned to opening 134 in device enclosure 130, thereby maintaining the appearance of the electronic device. This may be particularly helpful when printed circuit board 140 is positioned vertically during use, since such a position may cause printed circuit board 140 to sag relative to device enclosure 130.

In various embodiments of the present invention, printed circuit board 140 and device enclosure 130 may be at least approximately parallel in such a configuration, the pin may be at least relatively straight. That is, front portion 122 of the pin may be at least approximately aligned with rear portion 124 of the pin. In other embodiments the present invention, such as this example, printed circuit board 140 and device enclosure 130 may be oblique to each other. In this configuration, the pin may include one or more angle portions. In this example, rear portion 124 may be angled relative to find portion 122. More specifically, rear portion 124 may be angled relative to a main body of the pin (not shown), as well as front portion 122 of the pin. In other embodiments of the present invention, front portion 122 may be angled relative to the main body of the pin (not shown) and rear portion 124 of the pin. In still other embodiments of the present invention, the main body of the pin itself may include a bend such that it is angled.

In various embodiments of the present invention, instead of employing a separate pin, one or more protrusions may be formed on a front, back, or other sides of a connector receptacle. Further, instead of two end portions or protrusions, embodiments of the present invention may provide one, three, four, or more such portions or protrusions.

In various embodiments of the present invention, these protrusions may be formed as part of housing 110. In still other embodiments the present invention, these protrusions may be formed separately from housing 110. In still other embodiments the present invention, these protrusions may be formed as part of another portion of connector receptacle 110, for example, they may be formed as part of shield 116. In still other embodiments of the present invention, the pins or protrusions may be located in, or formed as part of, the housing of another structure, such as a standoff, electronic component, or other structure. These pins or protrusions may be angled or aligned relative to each other or to other structures in the electronic device or connector receptacle.

While in this embodiment of the present invention, rear portion 124 is shown as being angled to a main body of the pin and front portion 122, in other embodiments of the present invention, front portion 122 may be angled relative to the main body of the pin and rear portion 124 of the pin. Also, connector receptacle 100 may be located on a top surface of printed circuit board 140, or portions of connector receptacle 100 may be located in a hole, notch, or opening in printed circuit board 140. An example is shown in the following figure.

Figure 2:
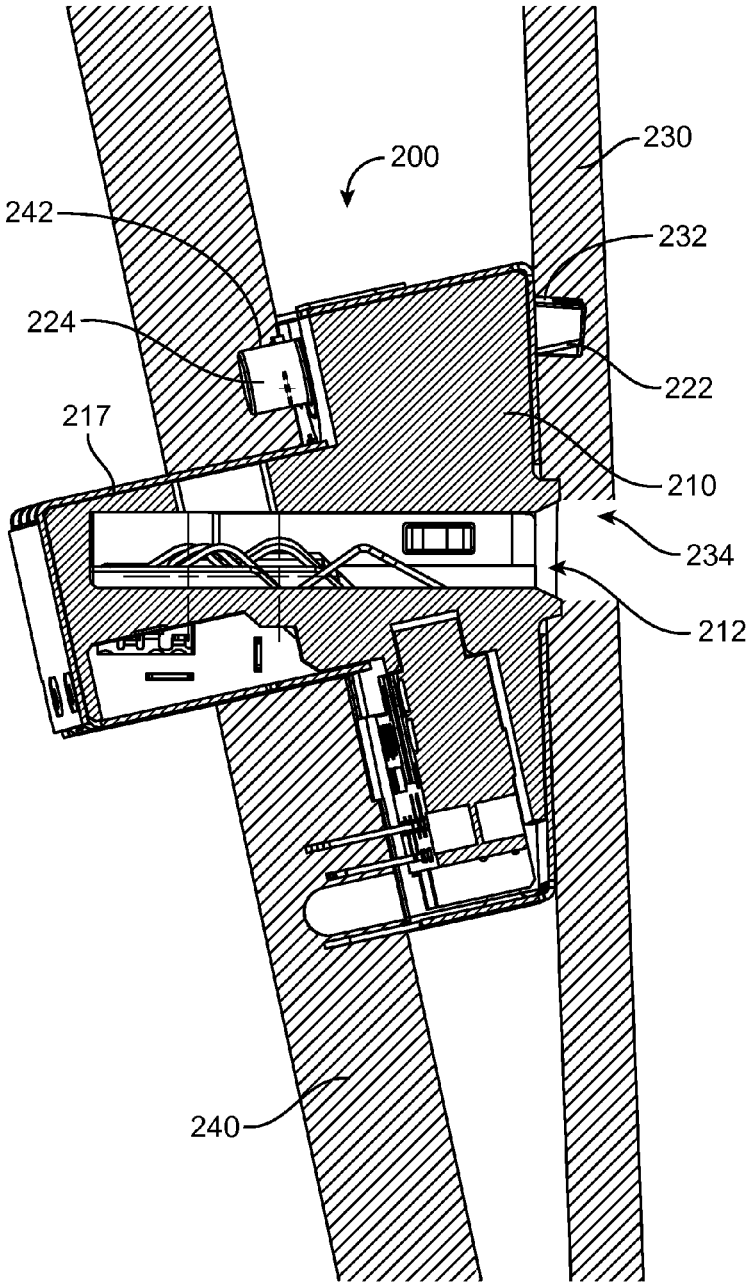
FIG. 2 illustrates another connector receptacle and portion of an electronic device according to an embodiment of the present invention.

FIG. 2 illustrates another connector receptacle and portion of an electronic device according to an embodiment of the present invention. Connector receptacle 200 may be located in an electronic device having device enclosure 230. Connector receptacle 200 may be located on printed circuit board, flexible circuit board, or other substrate 240. More specifically, lower portion 217 of connector receptacle 200 may be located in an opening or hole in printed circuit board or other substrate 240. Opening 212 of connector receptacle 200 may aligned with opening 234 in printed circuit board 230. A pin having a front portion 222 and a rear portion 224 may be located in a passage in housing 210. A front portion 122 of the pin may extend in front of housing 210 and be located in an opening or cavity 232 in device enclosure 230. The rear portion 224 of the pin may be located in an opening or cavity 242 in printed circuit board 240. Again, a front portion 222 of the pin may be angled relative to the main body of the pin (not shown) and rear portion 224.

Figure 3:
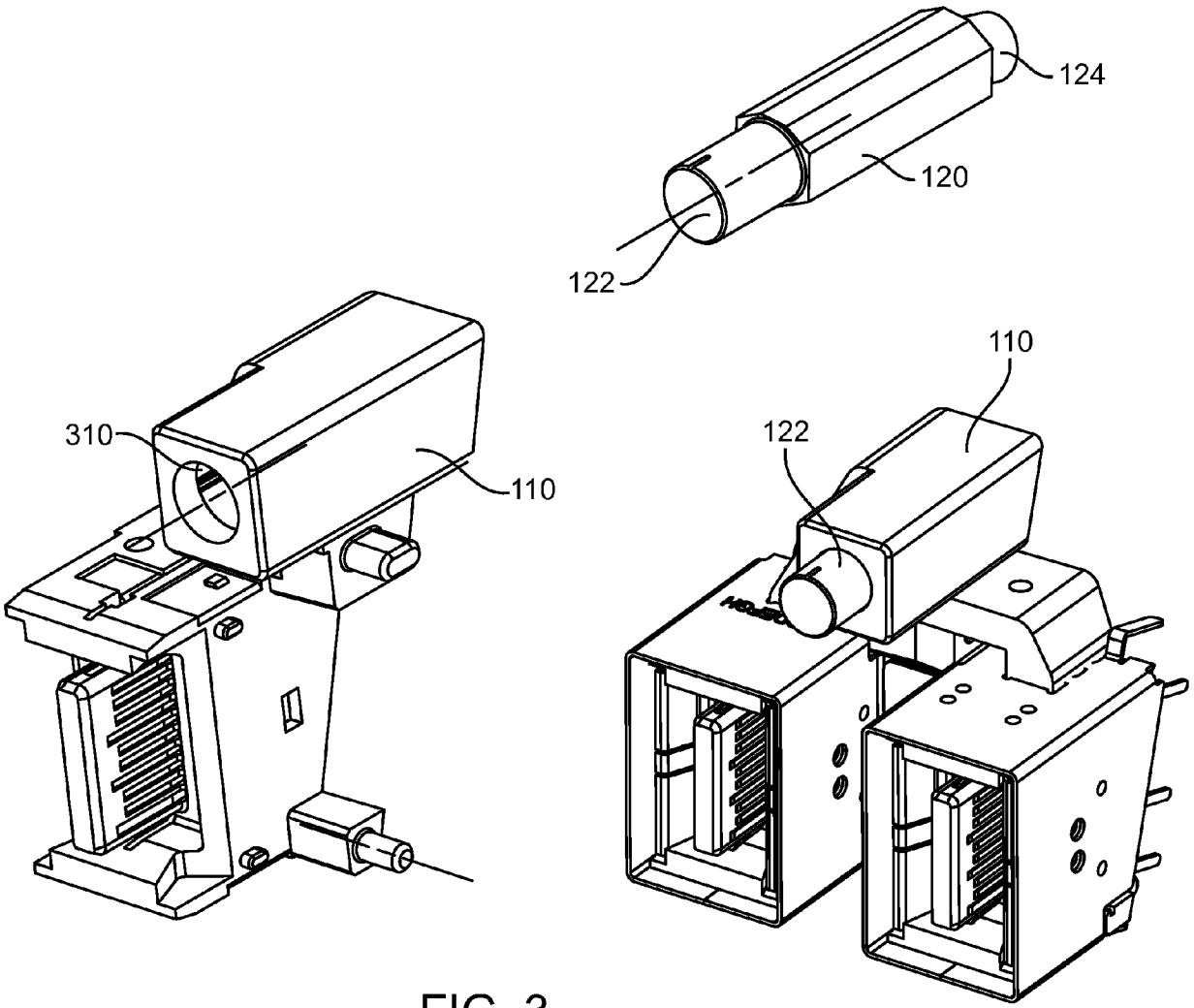
FIG. 3 illustrates the insertion of a pin into a passage in a connector receptacle housing according to an embodiment of the present invention.

FIG. 3 illustrates the insertion of a pin into a passage in a connector receptacle housing according to an embodiment of the present invention. Pin 120 having a main body portion 126, a front portion 122, and an angled rear portion 124 may be inserted into passage 310 in housing 120, as shown.

Figure 4:
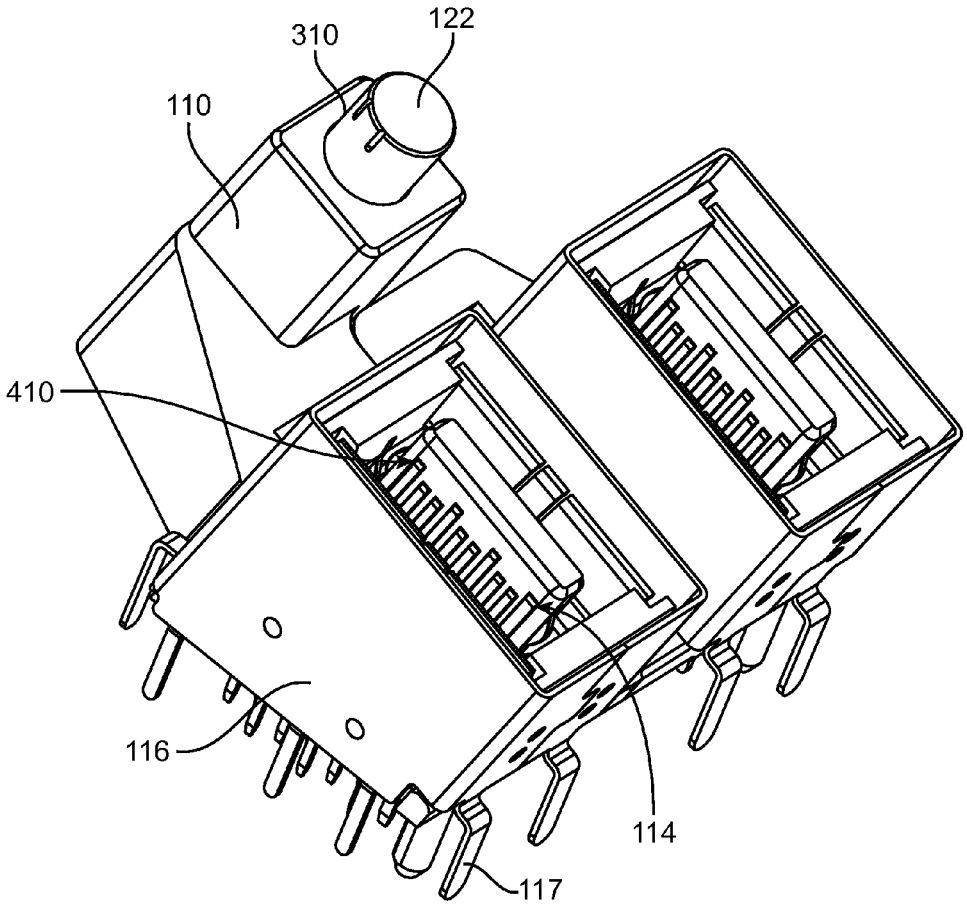
FIG. 4 illustrates a front view of a connector receptacle according to an embodiment of the present invention.

FIG. 4 illustrates a front view of a connector receptacle according to an embodiment of the present invention. Again, pin 120 may be inserted into passage 310 in housing 110. Front portion 122 of pin 120 may be exposed in a front of housing 110. Housing 110 may further include tongue 410 for supporting contact portions 114. Portions of housing 110 may be at least partially surrounded by shield 116. Shield 116 may include tabs 117.

Figure 5:
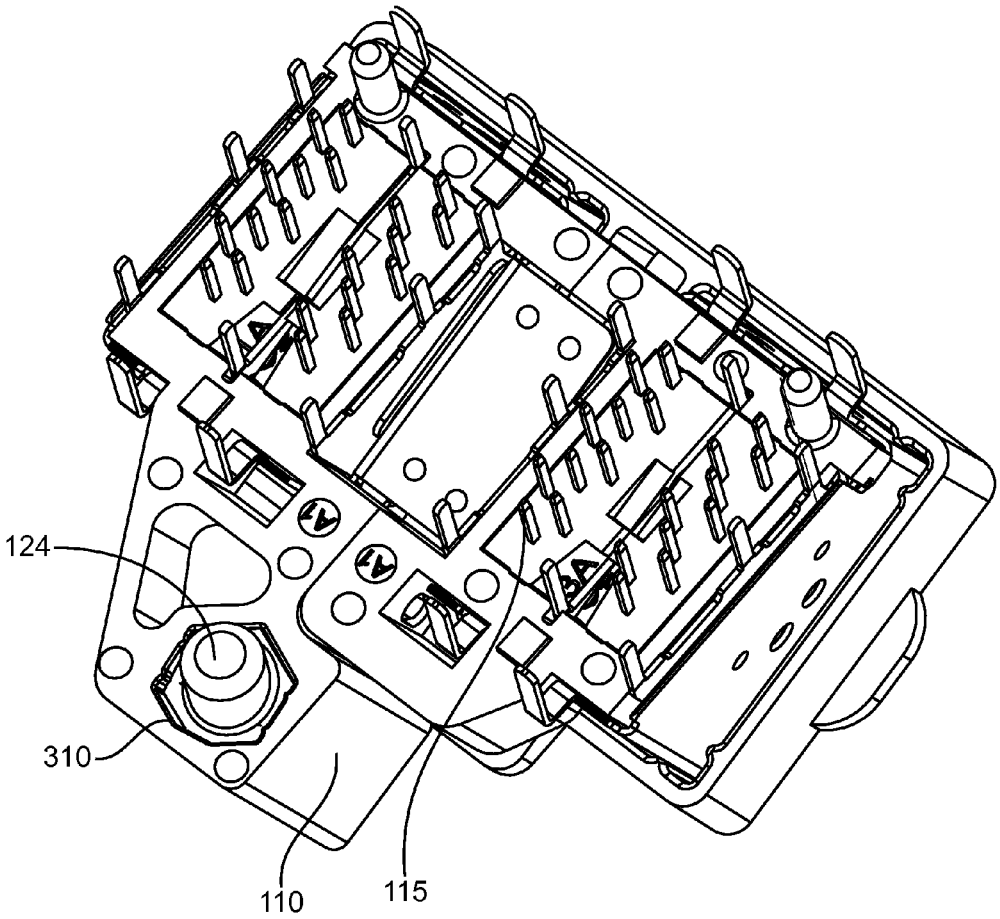
FIG. 5 illustrates a rear view of a connector receptacle according to an embodiment of the present invention.

FIG. 5 illustrates a rear view of a connector receptacle according to an embodiment of the present invention. Again, pin 120 may reside in passage 310 in housing 110. Rear portion 124 may be exposed at a rear of housing 110. Contact tail portions 115 may be available at a rear of housing 110.

Embodiments of the present invention may provide connector receptacles for various types of devices, such as portable computing devices, tablets, desktop computers, laptops, all-in-one computers, cell phone, smart phones, media phones, storage devices, portable media players, navigation systems, monitors and other devices. These connector receptacles may provide pathways for signals and power compliant with various standards such as Universal Serial Bus (USB), a High-Definition Multimedia Interface (HDMI), Digital Visual Interface (DVI), power, Ethernet, DisplayPort, Thunderbolt, Lightning and other types of interfaces.

Various portions of connector receptacle 110 may be formed of various materials. For example, the housings and protrusions may be formed of silicon or silicone, rubber, hard rubber, plastic, nylon, liquid-crystal polymers (LCPs), or other nonconductive material or combination of materials. The contacts, pins, and protrusions may be formed of stainless steel, steel, copper, copper titanium, phosphor bronze, or other material or combination of material. They may be plated or coated with nickel, gold, or other materials.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector receptacle comprising:
- a housing having a cavity and a passage, the cavity separate from the passage;
- a plurality of contacts located in the cavity of the housing; and
- a pin comprising:
  - a front portion extending away from a front of the housing;
  - a middle portion located in the passage of the housing; and
  - a rear portion extending away from a rear of the housing,
  - wherein the front portion of the pin is arranged to fit in a cavity in a device enclosure such that the cavity of the housing is aligned with an opening in device enclosure, wherein the device enclosure encloses an electronic device that includes the connector receptacle.

2. The connector receptacle of claim 1 wherein the rear portion of the pin is arranged to fit in a hole in a printed circuit board.

3. The connector receptacle of claim 2 wherein each of the contacts includes a contacting portion located in the cavity and a tail portion extending from the rear of the housing.

4. The connector receptacle of claim 3 wherein the housing is plastic and the pin is metallic.

5. The connector receptacle of claim 3 wherein the rear portion of the pin is angled relative to the front portion of the pin.

6. The connector receptacle of claim 3 wherein the rear portion of the pin is angled towards the tail portion of the contacts relative to the front portion of the pin.

7. An electronic device comprising:
- a device enclosure enclosing the electronic device and having a first opening and a first cavity;
- a printed circuit board having a first cavity; and
- a connector receptacle comprising:
  - a housing having a cavity and a passage, the cavity separate from the passage;
  - a plurality of contacts located in the cavity of the housing; and
  - a pin comprising:
    - a front portion extending away from a front of the housing into the cavity in the device enclosure;
    - a middle portion located in the passage of the housing; and
    - a rear portion extending away from a rear of the housing into the printed circuit board,
  - wherein the cavity of the housing is aligned with the opening in the device enclosure.

8. The electronic device of claim 7 wherein each of the contacts includes a contacting portion located in the cavity and a tail portion extending from the rear of the housing.

9. The electronic device of claim 8 wherein the housing is plastic and the pin is metallic.

10. The electronic device of claim 8 wherein the rear portion of the pin is angled relative to the front portion of the pin.

11. The electronic device of claim 8 wherein the rear portion of the pin is angled towards the tail portion of the contacts relative to the front portion of the pin.

12. A method of assembling an electronic device, the method comprising:

inserting a pin into a passage of a housing of a connector receptacle such that the pin includes a front portion extending away from a front of the housing, a middle portion located in the passage of the housing, and a rear portion extending away from a rear of the housing;

inserting the front portion of the pin into a cavity in a device enclosure enclosing the electronic device such that a cavity of the housing is aligned with an opening of a device enclosure, the cavity of the housing separate from the passage of the housing and including a plurality of contacts; and inserting the rear portion of the pin into a printed circuit board.

13. The method of claim 12 wherein the rear portion of the pin is angled relative to the front portion of the pin.

14. The method of claim 12 wherein the connector receptacle further comprises a plurality of contacts, each of the contacts including a contacting portion located in the cavity and a tail portion extending from the rear of the housing.

15. A connector receptacle comprising:

a housing having a cavity, a front protrusion, and a rear protrusion; and a plurality of contacts located in the cavity of the housing, wherein the front protrusion is arranged to fit in a cavity in a device enclosure enclosing an electronic device that includes the connector receptacle such that the cavity of the housing is aligned with an opening in the device enclosure and the rear protrusion is arranged to fit in a printed circuit board.

16. The connector receptacle of claim 15 wherein each of the contacts includes a contacting portion located in the cavity and a tail portion extending from the rear of the housing.

17. The connector receptacle of claim 16 wherein the housing, front protrusion, and rear protrusion are plastic.

18. The connector receptacle of claim 16 wherein the housing is plastic and the front protrusion and rear protrusion are metallic.

19. The connector receptacle of claim 16 wherein the rear protrusion is angled towards the tail portion of the contacts relative to the front protrusion.

20. The connector receptacle of claim 6 wherein a surface of the device enclosure having the cavity and the opening is at an oblique angle to the printed circuit board.

21. The electronic device of claim 10 wherein a surface of the device enclosure having the cavity and the opening is at an oblique angle to the printed circuit board.

22. The connector receptacle of claim 19 wherein a surface of the device enclosure having the cavity and the opening is at an oblique angle to the printed circuit board.

* * * * *